US007383974B2

(12) United States Patent
Moeller et al.

(10) Patent No.: US 7,383,974 B2
(45) **Date of Patent: *Jun. 10, 2008**

(54) COMBUSTION CHAMBER CONTROL FOR COMBUSTION-POWERED FASTENER-DRIVING TOOL

(75) Inventors: Larry M. Moeller, Mundelein, IL (US); James E. Doherty, Mount Prospect, IL (US); Joseph E. Fabin, Elmwood Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/501,316

(22) Filed: Aug. 9, 2006

(65) Prior Publication Data

US 2007/0034659 A1 Feb. 15, 2007

(51) Int. Cl.
*B25C 1/04* (2006.01)

(52) U.S. Cl. ..... 227/8; 227/10; 227/130; 123/46 SC

(58) Field of Classification Search ..... 227/8, 227/10, 130; 123/46 SC, 48
See application file for complete search history.

(56) References Cited

U.S. PATENT DOCUMENTS

| | | | | |
|---|---|---|---|---|
| 6,783,045 | B2 * | 8/2004 | Shima et al. | 227/8 |
| 6,826,935 | B2 * | 12/2004 | Gokcebay et al. | 70/278.3 |
| 6,971,568 | B2 * | 12/2005 | Schiestl et al. | 227/8 |
| 2005/0091962 | A1 * | 5/2005 | Van Erden et al. | 60/39.6 |
| 2005/0173484 | A1 * | 8/2005 | Moeller et al. | 227/8 |
| 2007/0131731 | A1 * | 6/2007 | Moeller et al. | 227/10 |

FOREIGN PATENT DOCUMENTS

| | | | | |
|---|---|---|---|---|
| DE | 2851739 | * | 2/2004 | 227/8 |

* cited by examiner

*Primary Examiner*—Louis K. Huynh
*Assistant Examiner*—Michelle Lopez
(74) *Attorney, Agent, or Firm*—Greer, Burns & Crain, Ltd.; Lisa M. Soltis; Mark W. Croll

(57) ABSTRACT

A combustion-powered fastener-driving tool includes a combustion-powered power source, a valve sleeve reciprocable relative to the power source between a rest position and a firing position, and a lockout device in operational proximity to the valve sleeve and configured for automatically preventing the reciprocation of the valve sleeve from the firing position until a piston in the power source returns to a pre-firing position.

7 Claims, 8 Drawing Sheets

COMBUSTION CHAMBER CONTROL FOR COMBUSTION-POWERED FASTENER-DRIVING TOOL

RELATED APPLICATION

This application claims priority under 35 USC §120 from U.S. Ser. No. 60/543,053, filed Feb. 9, 2004 and also from U.S. Ser. No. 11/028,432, filed Jan. 3, 2005.

BACKGROUND

The present invention relates generally to fastener-driving tools used to drive fasteners into workpieces, and specifically to combustion-powered fastener-driving tools, also referred to as combustion tools.

Combustion-powered tools are known in the art. Exemplary tools are manufactured by Illinois Tool Works, Inc. of Glenview, Ill. for use in driving fasteners into workpieces, and are described in commonly assigned patents to Nikolich U.S. Pat. Re. No. 32,452, and U.S. Pat. Nos. 4,522,162; 4,483,473; 4,483,474; 4,403,722; 5,133,329; 5,197,646; 5,263,439 and 6,145,724 all of which are incorporated by reference herein.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: cooling the engine, mixing the fuel and air within the chamber, and removing, or scavenging, combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade. Upon ignition of the combustible fuel/air mixture, the combustion in the chamber causes the acceleration of the piston/driver blade assembly and the penetration of the fastener into the workpiece if the fastener is present.

Combustion-powered tools now offered on the market are sequentially operated tools. The tool must be pressed against the workpiece, collapsing the workpiece contact element (WCE) relative to the tool before the trigger is pulled for the tool to fire a nail. This contrasts with tools which can be fired repetitively, also known as repetitive cycle operation. In other words, the latter tools will fire repeatedly by pressing the tool against the workpiece if the trigger is held in the depressed mode. These differences manifest themselves in the number of fasteners that can be fired per second for each style tool. The repetitive cycle mode is substantially faster than the sequential fire mode; 4 to 7 fasteners can be fired per second in repetitive cycle as compared to only 2 to 3 fasteners per second in sequential mode.

One distinguishing feature that limits combustion-powered tools to sequential operation is the manner in which the drive piston is returned to the initial position after the tool is fired. Combustion-powered tools utilize self-generative vacuum to perform the piston return function. Piston return of the vacuum-type requires significantly more time than that of pneumatic tools that use positive air pressure from the supply line for piston return.

With combustion-powered tools of the type disclosed in the patents incorporated by reference above, by firing rate and control of the valve sleeve the operator controls the time interval provided for the vacuum-type piston return. The formation of the vacuum occurs following the combustion of the mixture and the exhausting of the high-pressure burnt gases. With residual high temperature gases in the tool, the surrounding lower temperature aluminum components cool and collapse the gases, thereby creating a vacuum. In many cases, such as in trim applications, the operator's cycle rate is slow enough that vacuum return works consistently and reliably.

However, for those cases where a tool is operated at a much higher cycle rate, the operator can open the combustion chamber during the piston return cycle by removing the tool from the workpiece. This causes the vacuum to be lost and piston travel will stop before reaching the top of the cylinder. This leaves the driver blade in the guide channel of the nosepiece, thereby preventing the nail strip from advancing. The net result is no nail in the firing channel and no nail fired in the next shot.

To assure adequate closed combustion chamber dwell time in the sequentially-operated combustion tools identified above, a chamber lockout device is linked to the trigger. This mechanism holds the combustion chamber closed until the operator releases the trigger. This extends the dwell time (during which the combustion chamber is closed) by taking into account the operator's relatively slow musculature response time. In other words, the physical release of the trigger consumes enough time of the firing cycle to assure piston return. The mechanism also maintains a closed chamber in the event of a large recoil event created, for example, by firing into hard wood or on top of another nail. It is disadvantageous to maintain the chamber closed longer than the minimum time to return the piston, as cooling and purging of the tool is prevented.

Commonly-assigned U.S. Pat. No. 6,145,724 describes a cam mechanism that is operated by the driver blade to prevent premature opening of the combustion chamber prior to return of the piston/driver blade to the pre-firing position (also referred to as pre-firing). The main deficiency of this approach is that the piston requires the use of a manual reset rod to return the piston to pre-firing if the piston does not fully return due to a nail jam or perhaps a dirty/gummy cylinder wall. A piston that does not return will cause the chamber to remain closed; therefore the tool cannot be fired again.

Thus, there is a need for a combustion-powered fastener-driving tool which is capable of operating in a repetitive cycle mode. There is also a need for a combustion-powered fastener-driving tool which can address the special needs of delaying the opening of the combustion chamber to achieve complete piston return in a repetitive cycle mode.

BRIEF SUMMARY

The above-listed needs are met or exceeded by the present combustion-powered fastener-driving tool which overcomes the limitations of the current technology. Among other things, the present tool incorporates an electromechanical, or alternately, a purely mechanical mechanism configured for managing the chamber lockout that controls the length of time needed for vacuum piston return.

To achieve repeated high-cycle rate firing, in the preferred embodiment an electromagnetic device is used to function as the chamber lockout device instead of the manual trigger-operated mechanism for providing the desired delay. The control program used to manage this electromagnet includes a timer that assures the chamber is closed until the piston has returned.

More specifically, the present combustion-powered fastener-driving tool includes a combustion-powered power source, a workpiece contact element reciprocable relative to the power source between a rest position and a firing position. In the preferred embodiment, a lockout device is in operational proximity to said valve sleeve and configured for automatically preventing the reciprocation of the valve sleeve from the firing position until a piston in the power source returns to a pre-firing position.

DETAILED DESCRIPTION

Figure 1:
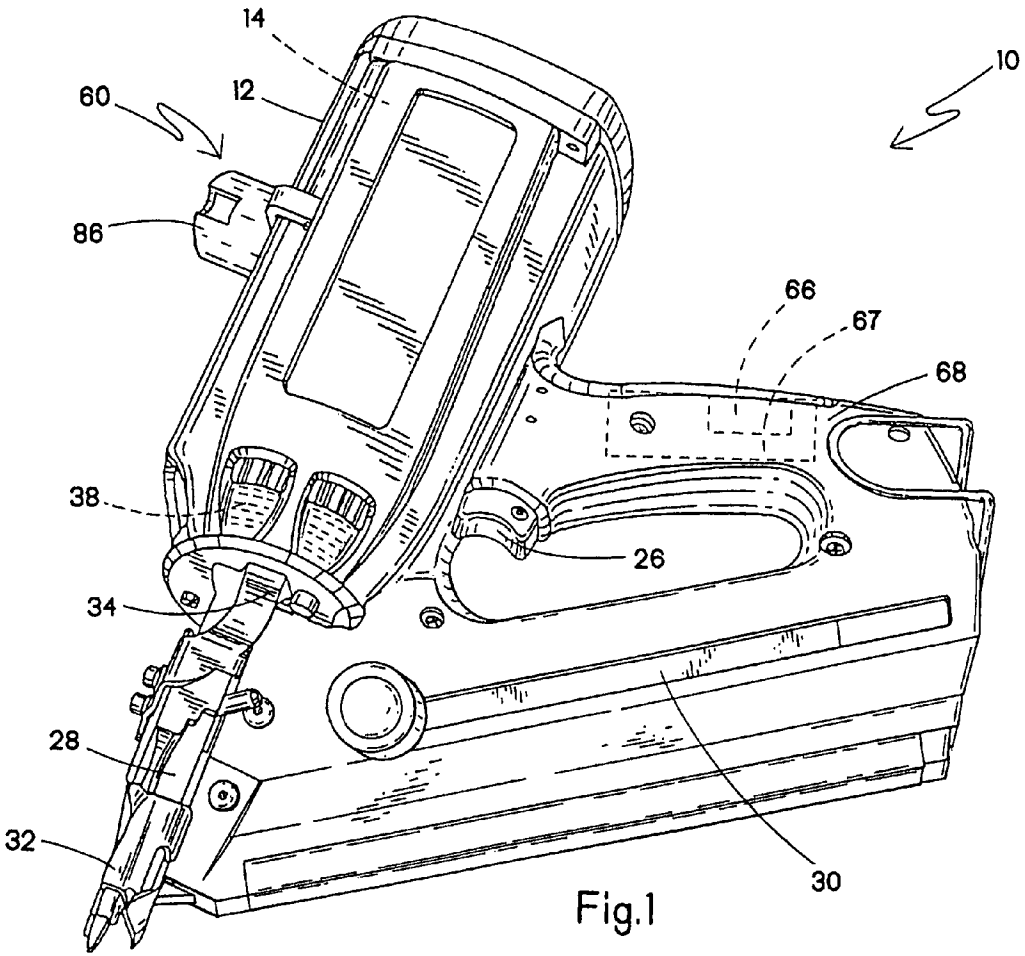
FIG. 1 is a front perspective view of a fastener-driving tool incorporating the present lockout system.
Figure 2:
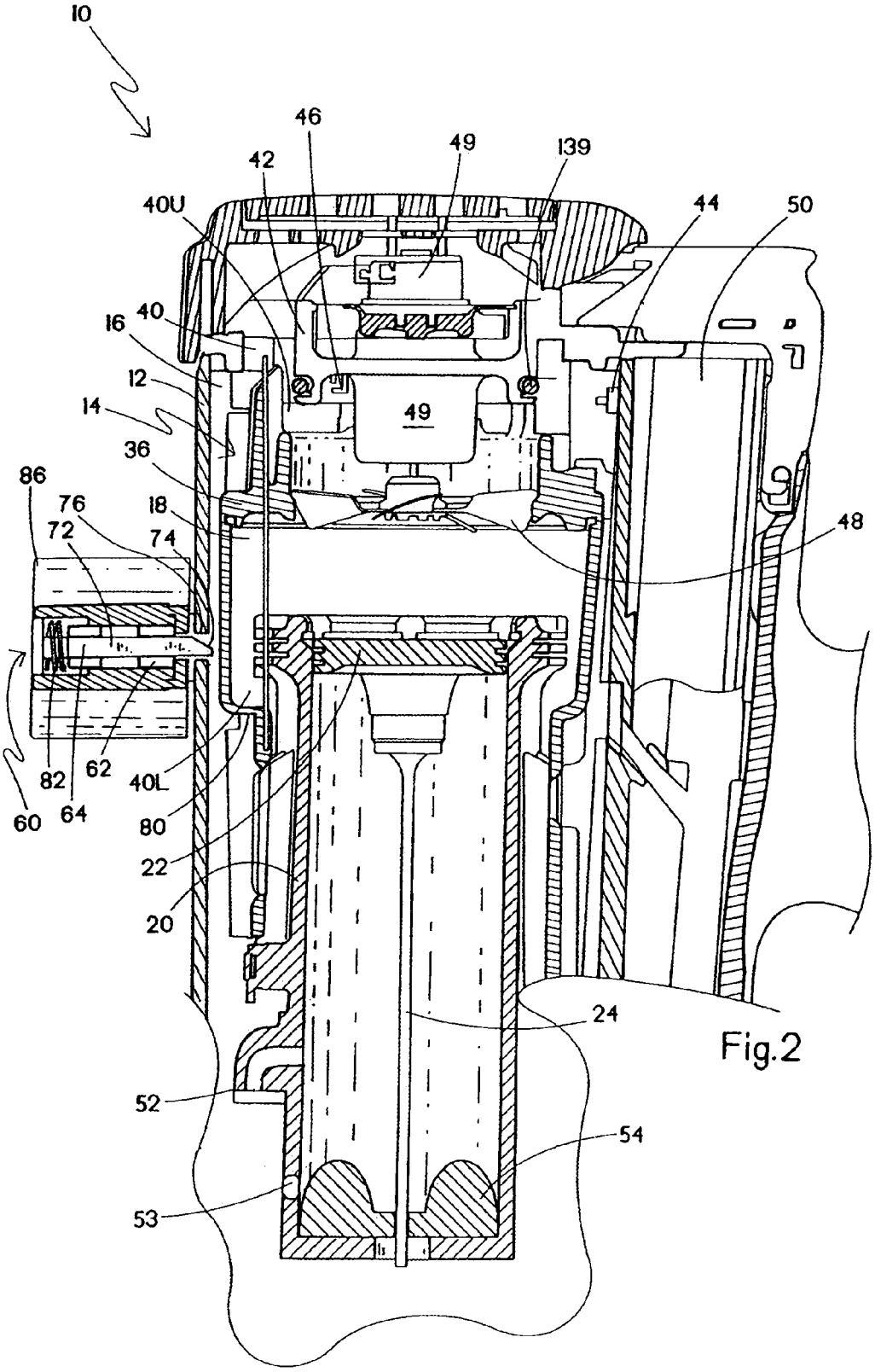
FIG. 2 is a fragmentary vertical cross-section of the tool of FIG. 1 shown in the rest position.
Figure 3:
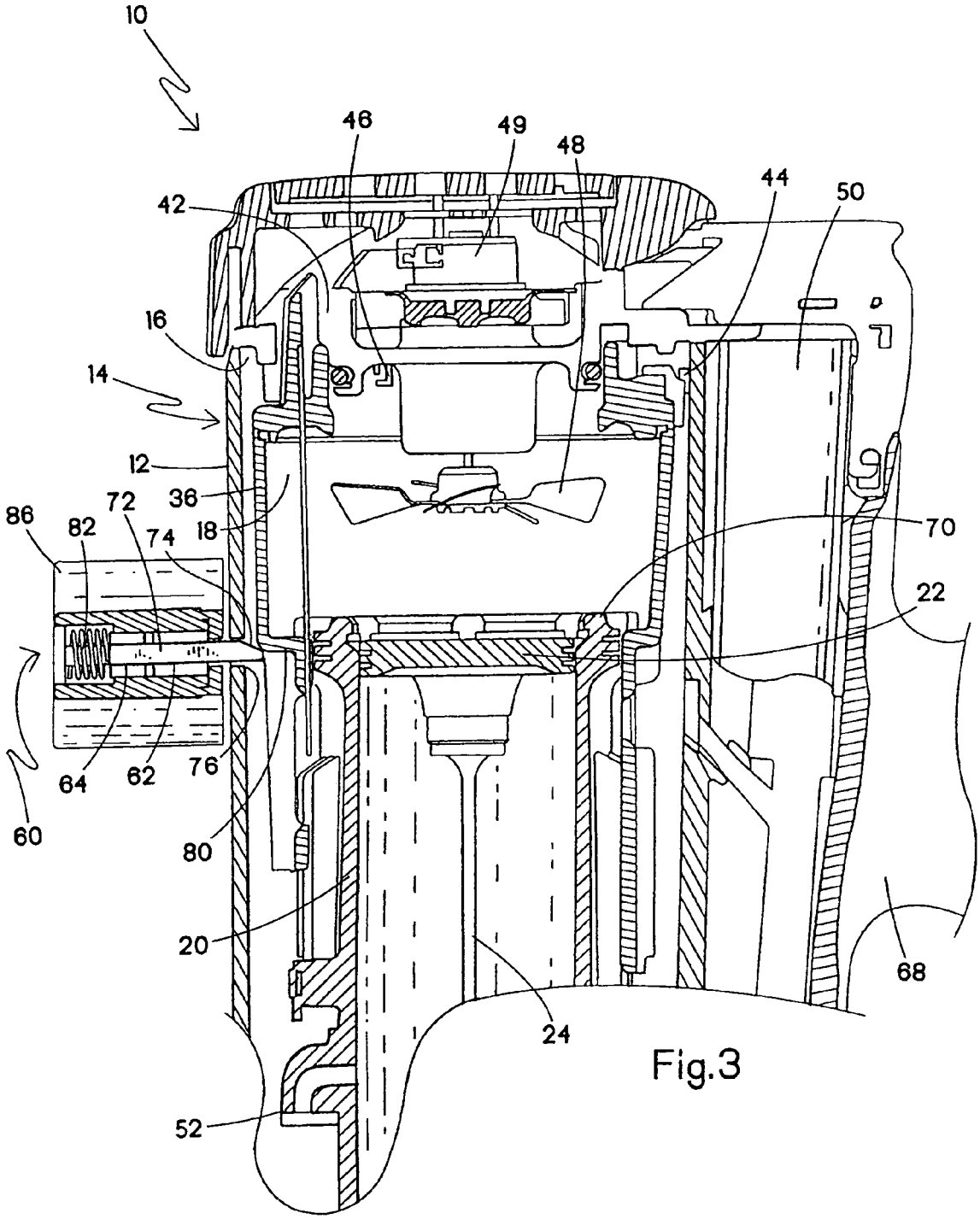
FIG. 3 is a fragmentary vertical cross-section of the tool of FIG. 2 shown in the pre-firing position.

Referring now to FIGS. 1-3, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

Through depression of a trigger 26, an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a firing position. This movement overcomes the normally downward biased orientation of the workpiece contact element 32 caused by a spring 38 (shown hidden in FIG. 1). It is contemplated that the location of the spring 38 may vary to suit the application, and locations displaced farther from the nosepiece 28 are envisioned.

Through the linkage 34, the workpiece contact element 32 is connected to and reciprocally moves with, the valve sleeve 36. In the rest position (FIG. 2), the combustion chamber 18 is not sealed, since there is an annular gap 40 separating the valve sleeve 36 and a cylinder head 42, which accommodates a chamber switch 44 and a spark plug 46. Specifically, there is an upper gap 40U near the cylinder head 42, and a lower gap 40L near the upper end of the cylinder 20. In the preferred embodiment of the present tool 10, the cylinder head 42 also is the mounting point for a cooling fan 48 and a fan motor 49 powering the cooling fan. The fan and at least a portion of the motor extend into the combustion chamber 18 as is known in the art and described in the patents which have been incorporated by reference above. In the rest position depicted in FIG. 2, the tool 10 is disabled from firing because the combustion chamber 18 is not sealed at the top with the cylinder head 42, and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gaps 40U and 40L and sealing the combustion chamber 18 until the chamber switch 44 is activated. This operation also induces a measured amount of fuel to be released into the combustion chamber 18 from a fuel canister 50 (shown in fragment).

Upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20 until near atmospheric pressure conditions are obtained and the check valve 52 closes. Due to internal pressure differentials in the cylinder 20, the piston 22 is returned to the pre-firing position shown in FIG. 2.

As described above, one of the issues confronting designers of combustion-powered tools of this type is the need for a rapid return of the piston 22 to pre-firing position and improved control of the chamber 18 prior to the next cycle. This need is especially critical if the tool is to be fired in a repetitive cycle mode, where an ignition occurs each time the workpiece contact element 32 is retracted, and during which time the trigger 26 is continually held in the pulled or squeezed position.

Figure 4:
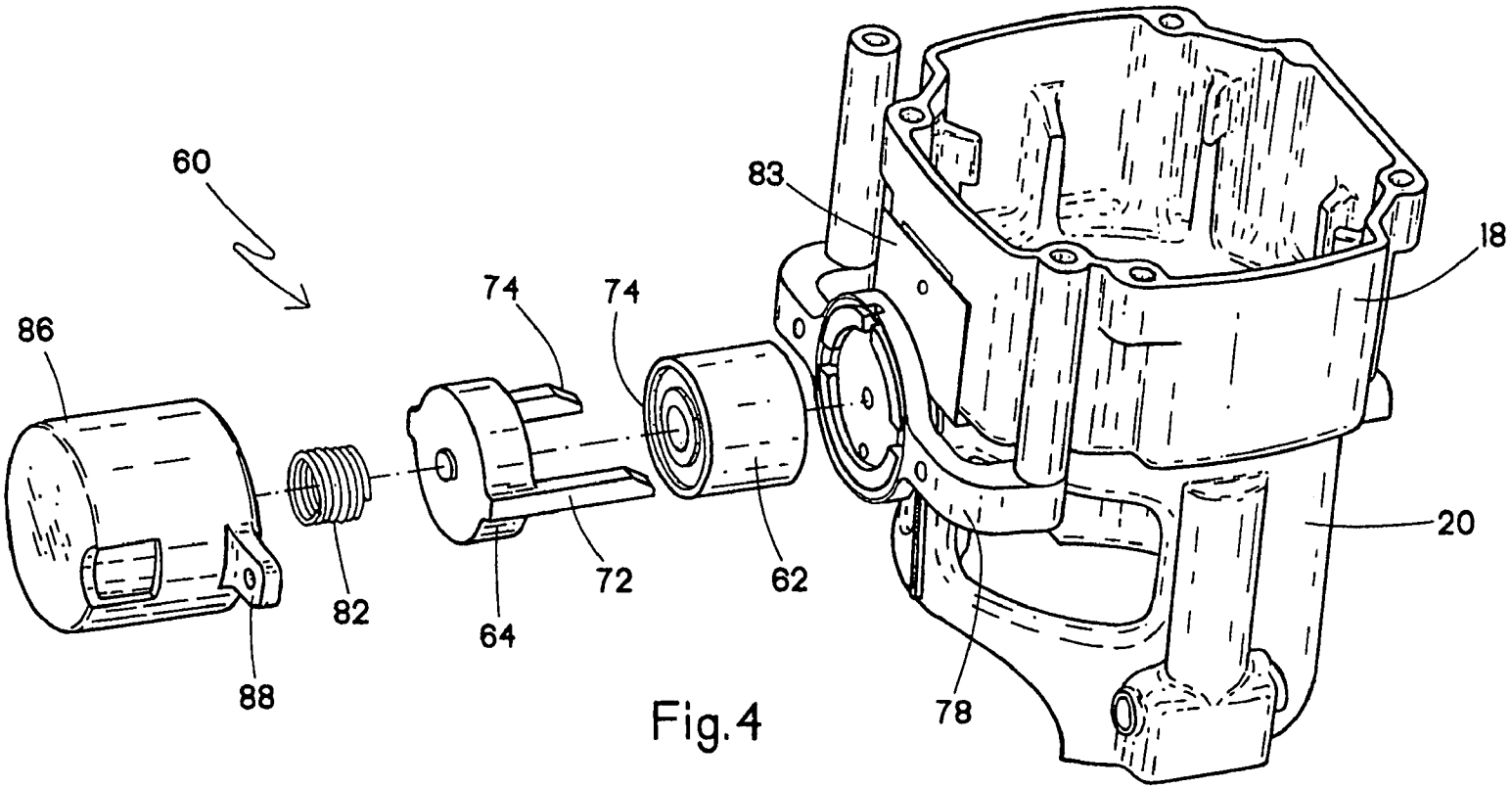
FIG. 4 is a fragmentary exploded perspective view of the tool of FIG. 1, specifically the combustion chamber and electromechanical chamber lockout device.

Referring now to FIGS. 2-4, to accommodate these design concerns, the present tool 10 preferably incorporates a lockout device, generally designated 60 and configured for preventing the reciprocation of the valve sleeve 36 from the closed or firing position until the piston 22 returns to the pre-firing position. This holding, delaying or locking function of the lockout device 60 is operational for a specified period of time required for the piston 22 to return to the pre-firing position. Thus, the operator using the tool 10 in a repetitive cycle mode can lift the tool from the workpiece where a fastener was just driven, and begin to reposition the tool for the next firing cycle. Due to the shorter firing cycle times inherent with repetitive cycle operation, the lockout device 60 ensures that the combustion chamber 18 will remain sealed, and the differential gas pressures maintained so that the piston 22 will be returned before a premature opening of the chamber 18, which would normally interrupt piston return. With the present lockout device 60, the piston 22 return and subsequent opening of the combustion chamber 18 can occur while the tool 10 is being moved toward the next workpiece location.

More specifically, and referring to FIGS. 2-4, the lockout device 60 includes an electromagnet 62 configured for engaging a sliding cam or latch 64 which transversely reciprocates relative to valve sleeve 36 for preventing the movement of the valve sleeve 36 for a specified amount of time. This time period is controlled by a control circuit or program 66 (FIG. 1) embodied in a central processing unit or control module 67 (shown hidden); typically housed in a handle portion 68 (FIG. 1) of the housing 12. While other orientations are contemplated, in the preferred embodiment, the electromagnet 62 is coupled with the sliding latch 64 such that the axis of the electromagnet's coil and the latch is transverse to the driving motion of the tool 10. The lockout device 60 is mounted in operational relationship to an upper portion 70 of the cylinder 20 so that sliding legs or cams 72 of the latch 64 having angled ends 74 pass through apertures 76 in a mounting bracket 78 and the housing 12 to engage a recess or shoulder 80 in the valve sleeve 36 once it has reached the firing position. As is seen in FIG. 4, the latch 64 is biased to the locked position by a spring 82 and is retained by the electromagnet 62 for a specified time interval.

For the proper operation of the lockout device 60, the control program 66 is configured so that the electromagnet 62 is energized for the proper period of time to allow the piston 22 to return to the pre-firing position subsequent to firing. As the operator pushes the tool 10 against the workpiece and the combustion chamber 18 is sealed, the latch 64 is biased against a wear plate 83 (FIG. 4), extending the legs 72. More specifically, when the control program 66, triggered by an operational sequence of switches (not shown) indicates that conditions are satisfactory to deliver a spark to the combustion chamber 18, the electromagnet 62 is energized by the control program 66 for approximately 100 msec. During this event, the latch 64 is held in position, thereby preventing the chamber 18 from opening. The period of time of energization of the electromagnet 62 is such that enough dwell is provided to satisfy all operating conditions for full piston return. This period may vary to suit the application.

The control program 66 is configured so that once the piston 22 has returned to the pre-firing position; the electromagnet 62 is deenergized, reducing the transversely directed force on the legs 72. As the user lifts the tool 10 from the workpiece, and following timed de-energization of the electromagnet 62, the spring 38 will overcome the force of the spring 82, and any residual force of the electromagnet 62, and will cause the valve sleeve 36 to move to the rest or extended position, opening up the combustion chamber 18 and the gaps 40U, 40L. This movement is facilitated by the cammed surfaces 74 of the legs 72, and retracts the legs as the valve sleeve 36 opens. As is known, the valve sleeve 36 must be moved downwardly away from the fan 48 to open the chamber 18 for exchanging gases in the combustion chamber and preparing for the next combustion.

In the preferred embodiment, a cover 86 encloses the spring 82, the latch member 64 and the electromagnet 62, and secures these items to the mounting bracket 78 through the use of eyelets 88 and suitable threaded fasteners, rivets or other fasteners known in the art (not shown). While in FIGS. 1-4 the electromagnet 62 is shown on a front of the housing 12, it is contemplated that it can be located elsewhere on the tool 10 or within the housing 12 as desired.

Figure 5:
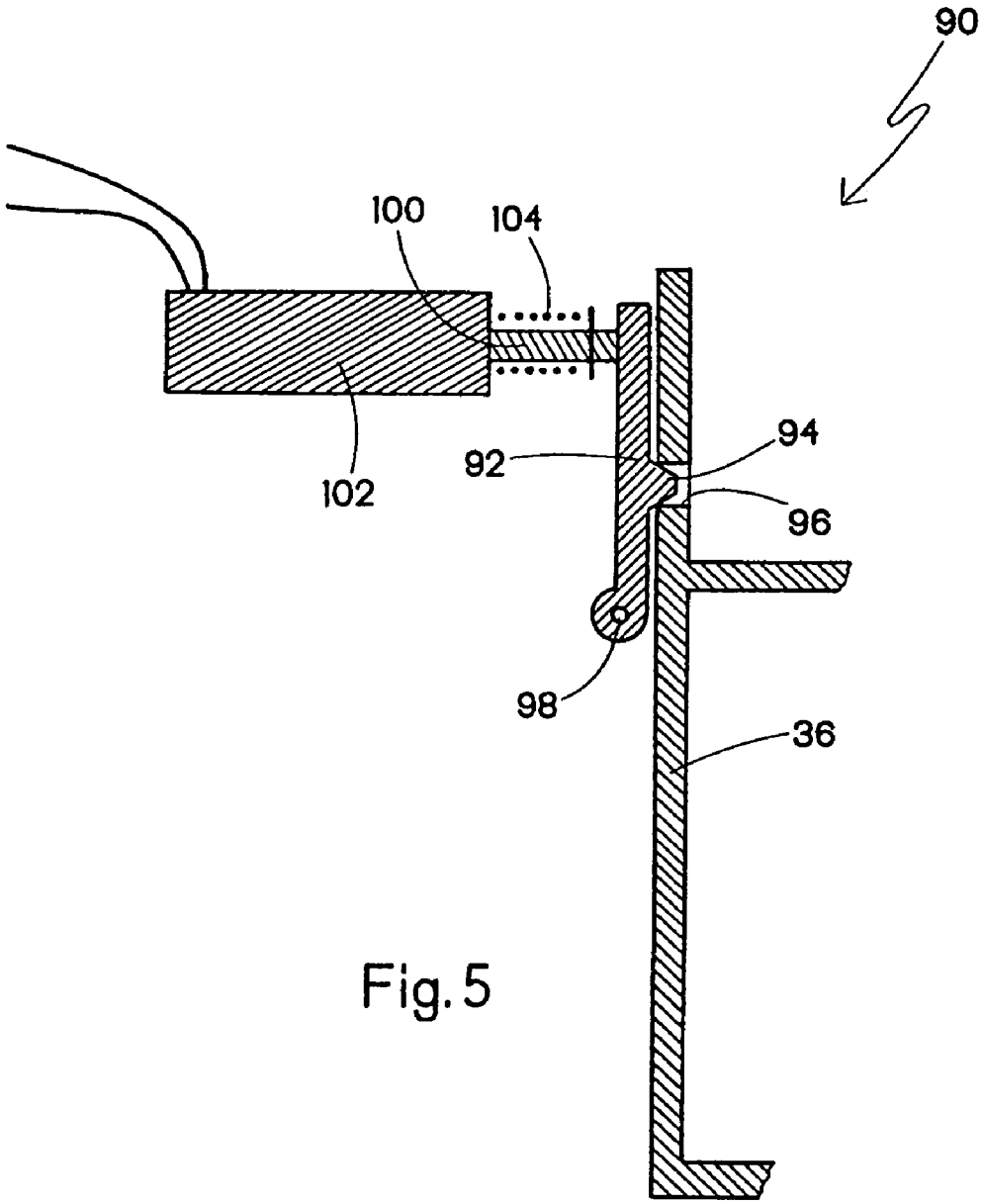
FIG. 5 is a schematic view of an alternate embodiment to the lockout system of FIGS. 2-4 shown in the lockout position.

Referring now to FIG. 5, an alternate embodiment of the lockout device 60 is designated 90. Shared components of the devices 60 and 90 are designated with identical reference numbers. The main difference between the devices is that the latch 64 is replaced by pivoting latch member 92 having a lug 94 which engages a recess 96 in the valve sleeve 36 once it reaches the closed position. The latch member 92 is pivotable about an axis or pivot point 98 such as a pin secured to the cylinder 20 or elsewhere on the tool 10. The axis 98 is generally transverse to the direction of reciprocation of the valve sleeve 36. A reciprocating plunger 100 of a solenoid 102 is associated with the latch member 92 to push the lug into engagement upon solenoid energization. The plunger 100 is preferably provided with a spring 104 for biasing pivoting latch member 92 against the valve sleeve 36 such that the lug 94 can fall into the recess 96. The valve sleeve 36 can return to the rest position to open the combustion chamber 18 upon timed de-energization of the solenoid 102. Retraction of the plunger 100 causes the spring 38 to pull the valve sleeve 36 downward, thus moving down the sloped upper surface of the lug 94 and forcing the latch member 92 out of engagement with the recess 96.

Figure 6:
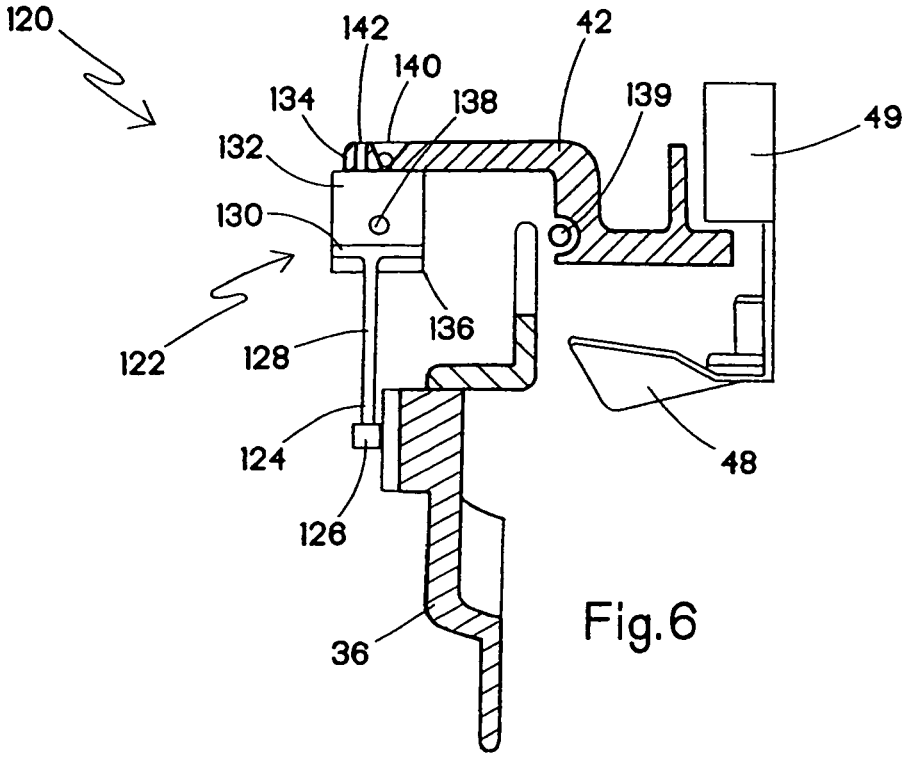
FIG. 6 is a fragmentary vertical cross-section of an alternate embodiment to the delay system of FIGS. 1-4 using a dashpot shown in the vent or rest position.
Figure 7:
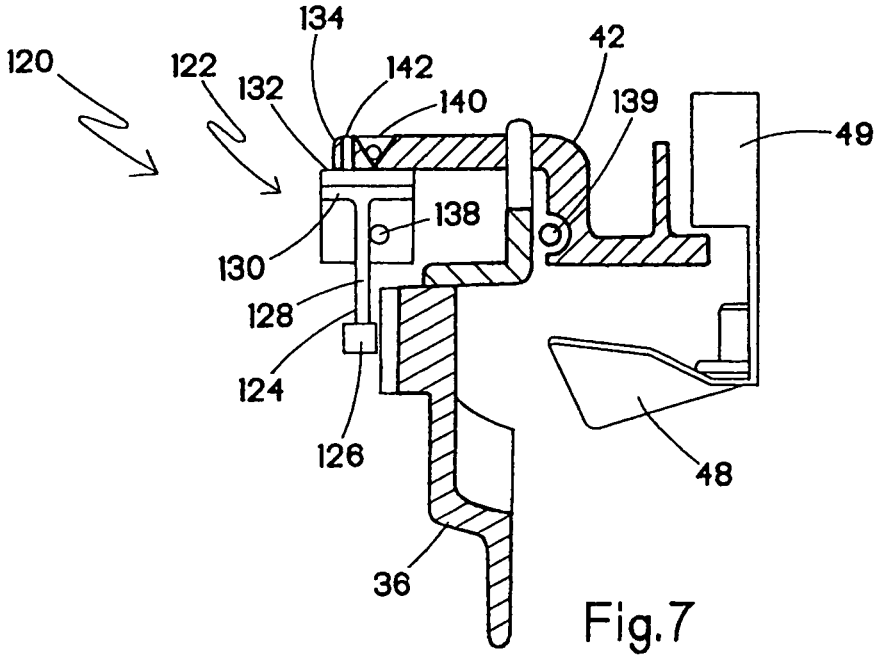
FIG. 7 is a fragmentary vertical cross-section of the embodiment of FIG. 6 shown in the pre-firing position.

Referring now to FIGS. 6 and 7, another alternate embodiment to the lockout delay device 60 is generally designated 120. In this embodiment, the components of the tool 10 which are identical have been designated with the same reference numbers. The main difference between the device 120 and the lockout device 60 is that instead of the electromagnet 62, the latch 64, the spring 82 and the cover 86, at least one mechanical dashpot generally designated 122 is provided. In general, the dashpot 122 is a mechanical device used for dampening or delaying motion between two points. In this case, the two points are the valve sleeve 36 and the cylinder head 42. While only one dashpot 122 is illustrated, the number and varied positioning of additional dashpots is contemplated depending on the application.

The dashpot 122 has two ends, each of which is attachable to either of the valve sleeve 36 or a fixed position associated with the power source 14. In the preferred embodiment, the fixed position is on the cylinder head 42. Aside from the cylinder head 42, other portions of the power source 14 which, during combustion cycles do not move relative to the valve sleeve 36 are also contemplated as being the fixed position. A first or rod end 124 is attachable to the valve sleeve 36 at a pin location 126 and includes a piston rod 128 and a piston 130.

As is known in the art, the dashpot 122 employs a slidable seal between a piston and a cylinder, pneumatic action or a viscous, fluid-like material to provide the delay or dampening movement. A second end 132 of the dashpot 122 is securable to the cylinder head 42 at a mounting location 134 and forms a cylinder with an open end 136 dimensioned to slidingly receive the piston 130. At least one vent opening or hole 138 is positioned on the cylinder 132 to correspond to the position of the valve sleeve 36 in the area of contact with a seal 139 on the cylinder head 42 prior to the pre-firing position (shown in FIG. 7). In this manner, the dashpot 122 only provides a delaying function when the piston 130 is disposed above the vent hole 138. The present dashpot design incorporates a check valve 140 to allow air in the dashpot cylinder 132 to be expelled when the tool 10 is actuated against the work. This prevents additional loading or feedback to the user.

In operation of the embodiment depicted in FIGS. 6 and 7, upon combustion, the dashpot effect, in this case vacuum formation, between the piston 130 and the cylinder 132 is such that the opening of the combustion chamber 18 is delayed for an amount of time allowing for the piston 22 to reach the uppermost or the pre-firing position. Once the operator lifts the tool 10 from the workpiece, the valve sleeve 36 begins to move away from the cylinder head 42, and is delayed only by the dashpot 122. The additional delaying action provided by the dashpot 122 is terminated or released once the piston 130 passes the vent hole 138.

When the tool 10 is raised off of the work surface, the dashpot 122 provides a controlled release rate of the chamber via an orifice-regulated intake of return air through an orifice 142. Preferably, this occurs over the portion of the movement of the valve sleeve 36 when the main combustion chamber seals 139 are effective. At the point where the seals 139 unseat through movement of the valve sleeve 36, the dashpot piston 130 exposes the vent hole 138, or series of holes, that makes the dashpot ineffective. The remainder of the chamber movement continues unimpeded. This minimizes the overall return opening time of the combustion chamber 18.

Figure 8:
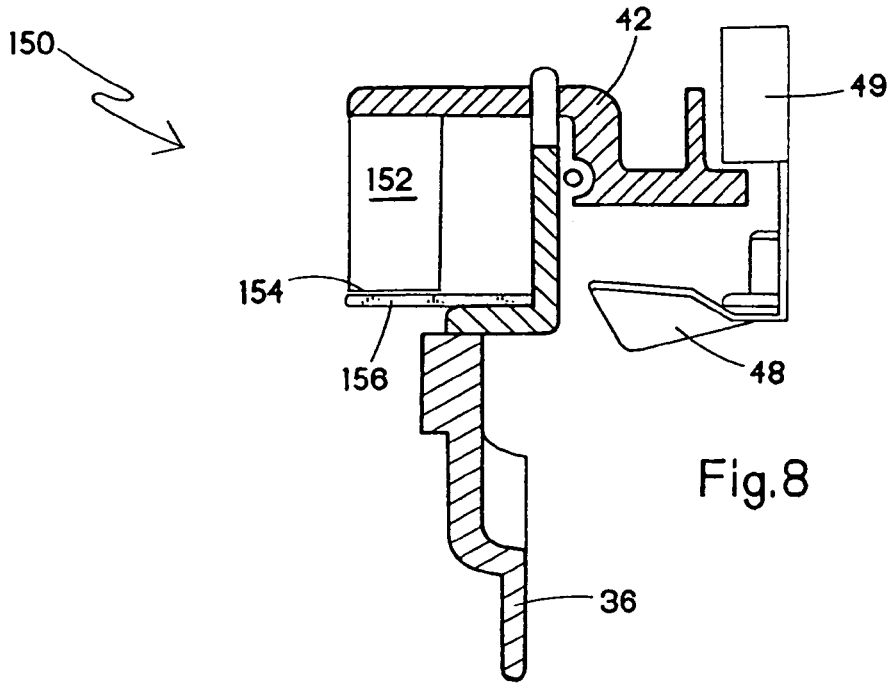
FIG. 8 is a fragmentary vertical cross-section of a second alternate embodiment to the delay system of FIGS. 1-4 using an electromagnet lockout device.

Referring now to FIG. 8, depicting the valve sleeve 36 in the pre-firing position, a second alternate embodiment to the lockout device is generally designated 150. Shared components with the embodiments of FIGS. 1-7 are designated with identical reference numbers. A main distinction of the embodiment 150 is that the delay of the opening of the valve sleeve 36 during the combustion cycle is obtained through an electromagnetic device 152 mounted to a fixed position on the power source 14, preferably the cylinder head 42, however other locations are contemplated. It will be seen that the electromagnetic device 152 operates along an axis which is parallel to the direction of reciprocation of the piston 22 and the valve sleeve 36. As is the case with the electromagnetic device 62, the device 152 is connected to the control program 66 and the CPU 67. The electromagnetic device 152 depends from the cylinder head 42 so that a contact end 154 is in operational relationship to the valve sleeve 36.

In the present embodiment, the valve sleeve 36 is provided with at least one radially projecting contact formation 156 constructed and arranged to be in registry with the contact end 154 of the device 152. While in the preferred version of this embodiment the contact formation 156 is shaped as a plate, the number, shape and positioning of the contact formation may vary to suit the application, as long as there is a sufficient magnetic attraction between the electromagnetic device 152 and the formation 156 when the valve sleeve 36 reaches the closed or pre-firing position (FIG. 3).

Upon reaching the pre-firing position, energization of the electromagnetic device 152 will create sufficient magnetic force to hold the contact plate 156, and by connection the valve sleeve 36, from reciprocal movement for a predetermined amount of time (determined by the control program 66) sufficient to permit return of the piston 22 to the pre-firing position (FIG. 3). Upon expiration of the predetermined amount of time controlled by the control program 66, the electromagnetic device 152 is deenergized, releasing the valve sleeve 36 so that internal gases can be exchanged for the next operational combustion cycle, as described above.

Figure 9:
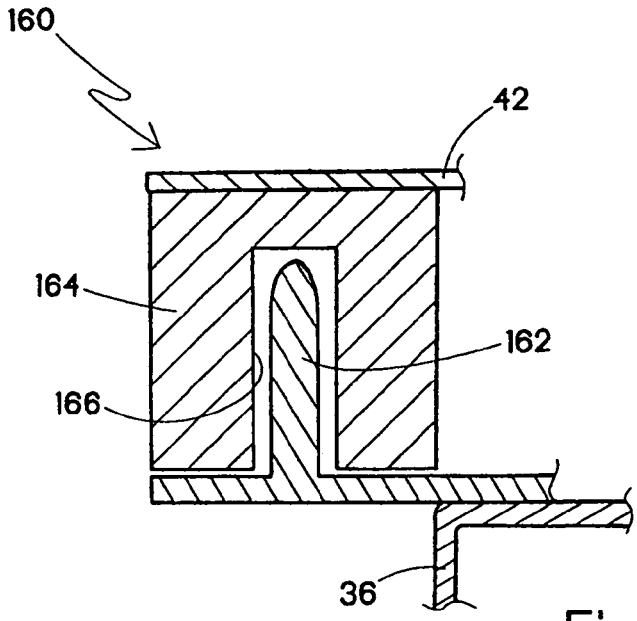
FIG. 9 is a fragmentary vertical cross-section of a third alternate embodiment to the delay system of FIGS. 1-4.

Referring now to FIG. 9, still another alternate embodiment of the lockout devices described above is generally designated 160. Shared components of the embodiments 60, 90, 120 and 150 are designated with identical reference numbers. The embodiment 160 operates similarly to the embodiment 150 in that it exerts an axial holding force on the valve sleeve 36 which is generally parallel to the direction of valve sleeve reciprocation.

In FIG. 9, the valve sleeve 36 is provided with a generally axially extending pin 162 made of a rigid, magnetic material such as a durable metal. An electromagnetic device 164 is secured to a fixed location on the power source 14, preferably on the cylinder head 42, however other locations are contemplated provided they remain in a fixed position relative to reciprocation of the valve sleeve 36. The electromagnetic device 164 is controlled by the control program 66 and is provided in a tubular or sleeve-like construction, defining an elongate passageway 166 dimensioned for matingly receiving the pin 162. Upon the valve sleeve 36 reaching the pre-firing position (FIG. 3), the control program 66 energizes the electromagnetic device 164, creating sufficient magnetic force to hold the pin 162 and thus prevent the valve sleeve 36 from moving reciprocally. The control program 66 also initiates a timer (not shown) which determines the amount of time the device 164 is energized, corresponding to the amount of time needed for piston return. As such, the piston 22 is permitted sufficient time to return to the pre-firing position prior to the next combustion cycle event.

Figure 10:
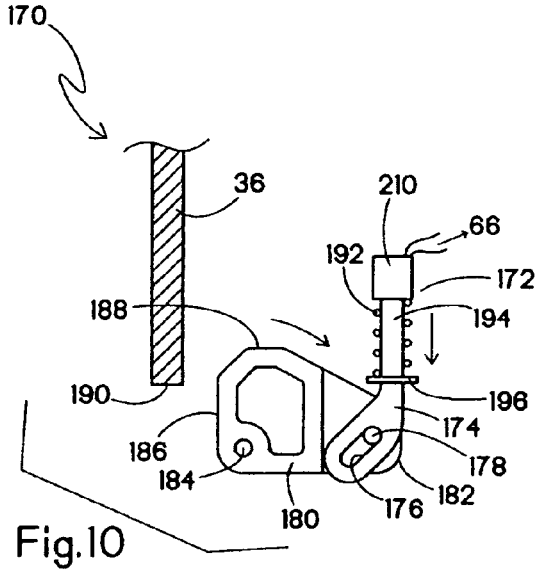
FIG. 10 is a schematic side elevation of a fourth alternate embodiment to the delay system of FIGS. 1-4 shown in a rest position.
Figure 11:
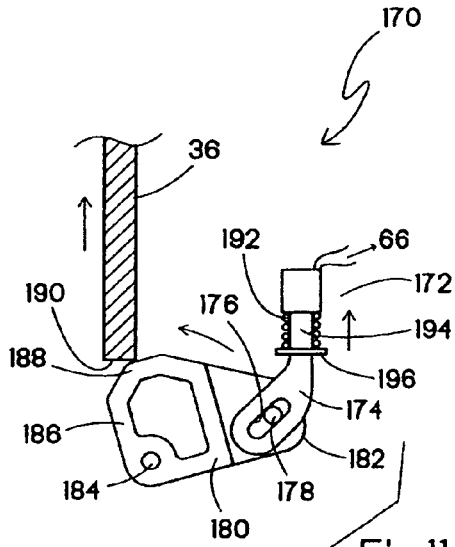
FIG. 11 is a schematic side elevation of the embodiment of FIG. 10 shown in the locked or delayed position associated with pre-firing.

Referring now to FIGS. 10 and 11, still another alternate embodiment to the lockout devices described above is generally designated 170. In this embodiment, a reciprocating electromagnetic solenoid 172 under the control of the control program 66 and the CPU 67 is oriented in the housing 12 to operate so that an axis of reciprocation is generally parallel to the movement of the valve sleeve 36. An operational or free end 174 of the solenoid 172 is configured as a dogleg, having an elongate slot 176 which engages a transverse pin 178 in a rotating cam 180. The pin 178 is located at one end 182 of the cam 180, and a pivot axis or pin 184 is located at an opposite end 186. A locking lobe 188 is formed on the opposite end 186 and is configured for engaging a lower end 190 of the valve sleeve 36.

A biasing device 192 such as a return spring is located on the solenoid 172 to return it, upon deenergization, to a rest or unlocked position shown in FIG. 10. The spring 192 is retained upon a main shaft 194 of the solenoid 172 by an annular, radially projecting flange 196. As is seen in FIG. 10, as long as the solenoid 172 is deenergized, the action of the spring 192 keeps the locking lobe 188 clear of the valve sleeve 36, which is permitted free reciprocal movement as occurs prior to combustion.

Referring now to FIG. 11, soon after the valve sleeve 36 reaches the closed or pre-firing position and conditions are satisfied for combustion (FIG. 3), the control circuit 66 energizes the solenoid 172 to retract the main shaft 194 and overcome the force generated by the spring 192. The resulting linear movement of the shaft 194 acts on the end 182 of the cam 180, rotating the locking lobe 188 into an engagement position with the lower end 190 of the valve sleeve 36. During this rotation, the transverse pin 178 moves in the slot 176.

As is the case with the other locking systems described above, the timing of the energization of the solenoid 172 is determined to be sufficient for achieving return of the piston 22 to the pre-firing position after combustion. At the conclusion of the preset energization period, the solenoid 172 is deenergized, and the force of the spring 192 causes movement of the locking lobe 188 away from the valve sleeve 36. Opening of the combustion chamber 18 is thus permitted for purging of exhaust gas.

Figure 12:
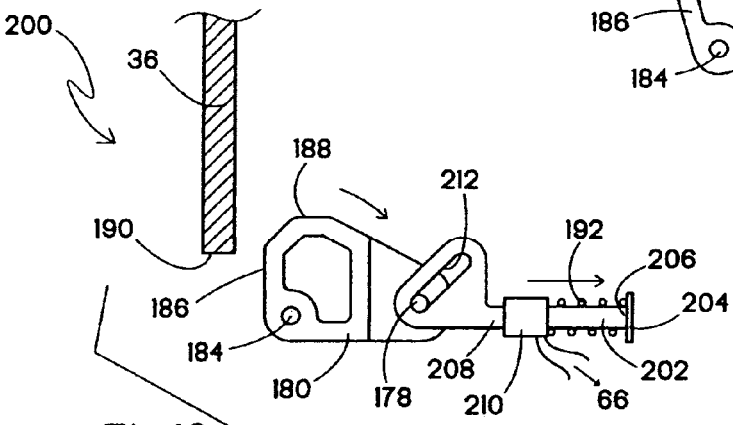
FIG. 12 is a schematic side elevation of an alternate embodiment to the delay system of FIGS. 10-11 in an orientation transverse to that of FIGS. 10 and 11 in a rest position.
Figure 13:
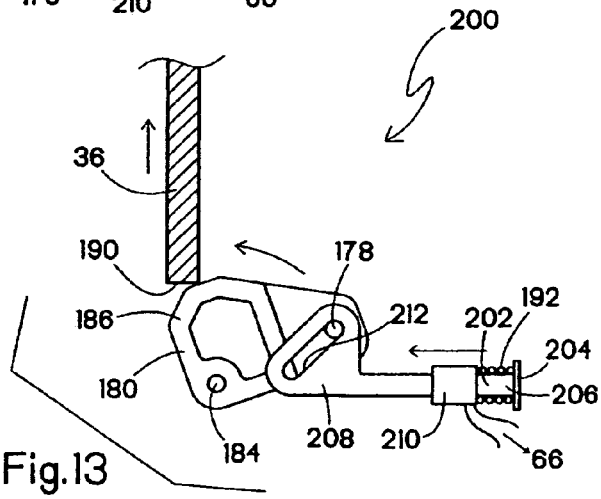
FIG. 13 is a schematic side elevation of the embodiment of FIG. 12 shown in the locked or delayed position associated with pre-firing.

Referring now to FIGS. 12 and 13, another embodiment of the lockout device 170 is generally designated 200. Shared components with the lockout device 170 are designated with identical reference numbers. Essentially, the mechanism 200 differs from the mechanism 170 by being oriented in the tool housing 12 so that the axis of reciprocation of a solenoid main shaft 202 is oriented generally normally or perpendicular to the axis of reciprocation of the valve sleeve 36. The solenoid main shaft 202 differs from the main shaft 194 in the positioning of the return spring 192 and a radially projecting flange 204 at an end 206 of the main shaft opposite a dogleg end 208. Also, the spring 192 and the flange 204 are on an opposite end of a solenoid unit 210 from the corresponding structure on the mechanism 170. A slot 212 in the dogleg end 208 extends angularly relative to the axis of reciprocation of the main shaft 202, and engages the transverse pin 178 of the rotating cam 180.

With the solenoid 210 deenergized, the return spring 192 pushes the annular flange 204 away from the valve sleeve 36, allowing for free valve sleeve movement up to the time of combustion. Referring now to FIG. 13, after the valve sleeve 36 has reached its uppermost position (FIG. 3) and conditions are satisfied for combustion, the control circuit 66 energizes the solenoid 210, overcoming the biasing force of the return spring 192, moving the main shaft 202 toward the valve sleeve 36 and causing the transverse pin 178 to move in the slot 212 so that the rotating cam 180 moves into locking engagement with the lower end 190 of the valve sleeve 36. This position is maintained by the control circuit 66 as in the case of the mechanism 170 for a designated period of time until the piston 22 to the pre-firing position.

While a particular embodiment of the present combustion chamber control for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source;

a valve sleeve reciprocable relative to said power source between a rest position and a firing position;

a lockout device in operational proximity to said valve sleeve and configured for automatically preventing the reciprocation of said valve sleeve from said firing position until a piston in said power source returns to a pre-firing position; and said lockout device includes an electromagnetic device configured for acting on a latch pivotable about a pivot point extending generally transverse to a direction of reciprocation of said valve sleeve.

2. The tool of claim 1 wherein said valve sleeve is provided with a recess, and said latch has a lug which engages said recess upon said valve sleeve reaching a closed position and energization of said electromagnetic device, causing pivoting of said latch into engagement with said valve sleeve.

3. The tool of claim 2 wherein said electromagnetic device is a solenoid with a reciprocating plunger constructed and arranged for engaging said latch member for pushing said lug into engagement with said recess upon energization of said solenoid.

4. The tool of claim 2 wherein said valve sleeve is biased toward said rest position and upon energization said electromagnetic device restrains said valve sleeve in said firing position, and said lug has a sloped upper surface which is engaged by said valve sleeve upon deenergization of said electromagnetic device which releases said valve sleeve, and said biased movement of said valve sleeve toward said rest position forces disengagement of said lug from said recess in valve sleeve.

5. A combustion-powered fastener-driving tool, comprising:

a combustion-powered power source;

a valve sleeve reciprocable relative to said power source between a rest position and a firing position;

a lockout device in operational proximity to said valve sleeve and configured for automatically preventing the reciprocation of said valve sleeve from said firing position until a piston in said power source returns to a pre-firing position;

said lockout device includes an electromagnetic device configured for acting on a latch pivoting about a pivot point extending transverse to a direction of reciprocation of said valve sleeve; and said valve sleeve is provided with a recess, and said latch has a lug which engages said recess upon said valve sleeve reaching a closed position and energization of said electromagnetic device, causing pivoting of said latch into engagement with said valve sleeve.

6. The tool of claim 5 wherein said electromagnetic device is a solenoid with a reciprocating plunger constructed and arranged for engaging said latch member for pushing said lug into engagement with said recess upon energization of said solenoid.

7. The tool of claim 5 wherein said valve sleeve is biased toward said rest position and upon energization said electromagnetic device restrains said valve sleeve in said firing position, and said lug has a sloped upper surface which is engaged by said valve sleeve upon deenergization of said electromagnetic device which releases said valve sleeve, and said biased movement of said valve sleeve toward said rest position forces disengagement of said lug from said recess in valve sleeve.

* * * * *

UNITED STATES PATENT AND TRADEMARK OFFICE

CERTIFICATE OF CORRECTION

PATENT NO. : 7,383,974 B2
APPLICATION NO. : 11/501316
DATED : June 10, 2008
INVENTOR(S) : Moeller et al.

It is certified that error appears in the above-identified patent and that said Letters Patent is hereby corrected as shown below:

On the Title Page:

Insert --(62) Related U.S. Application Data--.

Under (62) Related U.S. Application Data, insert --Division of application No. 11/028,432, filed on Jan. 3, 2005.--.

In the Spec:

In Column 1, Line 9, insert --This is a divisional of application Ser. No. 11/028,432, filed Jan. 3, 2005.--.

Signed and Sealed this

Third Day of November, 2009

David J. Kappos

David J. Kappos
*Director of the United States Patent and Trademark Office*